US006398916B1

(12) United States Patent
Klerelid

(10) Patent No.: US 6,398,916 B1
(45) Date of Patent: Jun. 4, 2002

(54) SIMPLIFIED THROUGH-AIR DRYING PAPER MAKING MACHINE HAVING A TWIN WIRE FORMING SECTION

(75) Inventor: Berndt Erik Ingvar Klerelid, Karlstad (SE)

(73) Assignee: Valmet Karlstad AB, Karlstad (SE)

( * ) Notice: Subject to any disclaimer, the term of this patent is extended or adjusted under 35 U.S.C. 154(b) by 0 days.

(21) Appl. No.: 09/464,120

(22) Filed: Dec. 16, 1999

(51) Int. Cl.[7] ..... D21F 9/00
(52) U.S. Cl. ..... 162/290; 162/301; 162/359.1
(58) Field of Search ..... 162/116, 203, 162/206, 207, 301, 290, 359.1, 375

(56) References Cited

U.S. PATENT DOCUMENTS

| | | | | |
|---|---|---|---|---|
| 3,303,576 A | | 2/1967 | Sisson | |
| 3,400,045 A | * | 9/1968 | Graham | 162/301 |
| 3,745,066 A | * | 7/1973 | Blever | 162/359.1 |
| 3,891,500 A | * | 6/1975 | Kankaanpaa | 162/359.1 |
| 4,102,737 A | | 7/1978 | Morton | |
| 4,166,001 A | * | 8/1979 | Dunning | 162/207 |
| 4,302,282 A | * | 11/1981 | Young | 162/206 |
| 4,406,739 A | | 9/1983 | Kankaanpaa | |
| 4,759,391 A | * | 7/1988 | Waldvogel et al. | 162/116 |
| 4,879,001 A | | 11/1989 | Cronin | |
| 5,494,554 A | | 2/1996 | Edwards et al. | |
| 5,529,665 A | | 6/1996 | Kaun | |
| 5,730,839 A | | 3/1998 | Wendt et al. | |
| 5,851,629 A | | 12/1998 | Oriaran et al. | |
| 5,853,539 A | | 12/1998 | Smith et al. | |
| 5,882,479 A | | 3/1999 | Oriaran et al. | |

FOREIGN PATENT DOCUMENTS

| | | |
|---|---|---|
| CA | 2078877 | 6/2000 |
| EP | 91919037 | 4/1991 |
| WO | WO 91/16493 | 10/1991 |
| WO | WO 99/60205 | 11/1999 |

* cited by examiner

*Primary Examiner*—Karen M. Hastings
(74) *Attorney, Agent, or Firm*—Alston & Bird LLP

(57) ABSTRACT

A through-air drying paper making apparatus is provided comprising a twin-fabric forming section, a water-removing section arranged downstream of the forming section, and a web transfer device disposed between the forming section and the water-removing section. The forming section includes a forming roll, a pair of fabrics guided to travel about a portion of the circumference of the forming roll, and a headbox operable to deposit a slurry between the fabrics so as to form a paper web therebetween. Preferably, one of the fabrics in the forming section comprises a through-air drying (TAD) fabric arranged to carry the paper web through the water-removing section, while the other fabric comprises a forming wire. At the web transfer device, the paper web is separated from the forming wire and the paper web then carried on the TAD fabric through the water-removing section. The water-removing section includes at least one through-air dryer for at least partially drying the paper web. Most preferably, the forming section and the web transfer device are arranged such that the forming wire and the TAD fabric, with the paper web sandwiched therebetween, travel along a substantially straight and relatively short path between the forming roll and the web transfer device, thereby resulting in minimal directional change of the paper web after formation thereof about the forming roll and prior to separation of the paper web from the forming wire. An associated method is also provided.

4 Claims, 6 Drawing Sheets

SIMPLIFIED THROUGH-AIR DRYING PAPER MAKING MACHINE HAVING A TWIN WIRE FORMING SECTION

FIELD OF THE INVENTION

The present invention relates to paper making machines and, more particularly, to a through-air drying paper making machine having a twin-fabric forming section.

BACKGROUND OF THE INVENTION

A paper making machine necessarily includes a forming section for forming a paper web. The forming section may have different configurations depending on the characteristics desired of the paper web to be formed. For example, a through-air drying (TAD) paper making machine for making tissue typically has a forming section where the web is formed and usually partially dewatered before the web is transferred to a through-air drying fabric for further water removal in at least one through-air drying unit. In some instances, a TAD machine may have a twin wire forming section which forms the tissue paper web between two forming fabrics. Once the paper web is formed, it may be partially dewatered before it is transferred from the forming fabrics to a TAD fabric, wherein the TAD fabric transports the paper web through the TAD units in order to dry the paper web. TAD paper making machines having a twin wire forming section, therefore, usually have at least three fabrics for forming and drying the paper web. Accompanying each fabric in a TAD paper making machine is an associated investment cost, operational and maintenance requirements, and a number of moving parts. Typically, each additional fabric results in a larger footprint occupied by the paper making machine. Also, the TAD fabric in a typical TAD paper making machine usually retains a significant amount of the water removed from the paper web after the paper web has been transported through the TAD unit(s). Ordinarily, the water retained in the TAD fabric must be removed by relatively sophisticated equipment before returning to receive more of the partially dewatered paper web from the twin wire forming section in order to avoid re-watering of the partially dewatered paper web. The provisions necessary for removing water from the TAD fabric thereby add further investment costs and operational expenses to the paper making process. Thus, there exists a need for a simplified TAD paper making machine for minimizing investment costs which is more efficient in terms of operational, maintenance, size, and space concerns.

One example of a paper making machine having a twin wire forming section is disclosed by U.S. Pat. No. 4,102,737 to Morton which describes a process and apparatus for forming a paper web having improved bulk and absorptive capacity. The apparatus disclosed by the Morton '737 patent comprises a twin wire forming section where a paper web is formed between a forming wire and a foraminous drying/imprinting fabric about a conventional twin wire forming roll. After the paper web is formed between the forming wire and the drying/imprinting fabric, this "laminate sandwich" passes over a direction changing roll and then across one or more vacuum boxes to increase the fiber consistency of the paper web. The laminate sandwich is then directed about a conventional rubber covered couch roll for changing direction thereof downwardly to a vacuum pickup shoe mounted against the inside face of the drying/imprinting fabric. The forming wire is then separated from the laminate sandwich such that the paper web remains in contact with the drying/imprinting fabric.

However, the apparatus disclosed by the Morton '737 patent subjects the formed paper web, sandwiched between the forming wire and the drying/imprinting fabric, to two changes of direction of approximately 90 degrees each. The first change of direction occurs after the paper web has been formed about the forming roll, where the laminate sandwich passes over the direction changing roll to be directed across the vacuum boxes. The second change of direction occurs as the laminate sandwich is passed over the couch roll and directed to the vacuum pickup shoe. As shown in FIG. 1 of the '737 patent, the paper web sandwiched between the two fabrics is thus subject to a total directional change of approximately 180 degrees after it is formed at the forming roll and before the forming wire is separated therefrom. Due to the different distances traversed by each of the inner and the outer fabrics as they pass over a direction changing component, the fabric immediately adjacent the component, or the inner fabric, will tend to shift in position so as to run ahead of the fabric disposed opposite the inner fabric from the component, or the outer fabric, each time the laminate sandwich is subject to a change of direction. Changing the direction of the laminate sandwich therefore causes one of the fabrics to run ahead of the other and thereby causes deleterious shear forces in the paper web disposed therebetween. Thus, there exists a need for a twin wire forming section for a paper making machine capable of forming and dewatering a paper web while minimizing shear forces in the paper web before it is subjected to subsequent downstream water-removing processes.

Thus, there exists a need for a twin wire formation type paper making machine having a lower investment cost with correspondingly lower operational, maintenance, and space concerns. Such a paper making machine should also be capable of forming a paper web and transporting the paper web to subsequent downstream water-removing processes while minimizing deleterious shear forces in the paper web to thereby obtain a more consistent and damage-free paper web.

SUMMARY OF THE INVENTION

The above and other needs are met by the present invention which, in one embodiment, provides a paper making apparatus comprising a twin-fabric forming section, a water-removing section arranged downstream of the forming section, and a web transfer device disposed between the forming section and the water-removing section. The forming section includes a forming roll, a pair of fabrics guided to travel about a portion of the circumference of the forming roll, and a headbox operable to deposit a slurry between the fabrics so as to form a paper web therebetween. Preferably, one of the fabrics in the forming section comprises a through-air drying (TAD) fabric arranged to carry the paper web through the water-removing section, while the other fabric comprises a forming wire. At the web transfer device, the paper web is separated from the forming wire and the paper web then carried on the TAD fabric through the water-removing section. The water-removing section includes at least one through-air dryer for at least partially drying the paper web. Most preferably, the forming section and the web transfer device are arranged such that the forming wire and the TAD fabric, with the paper web sandwiched therebetween, travel along a substantially straight path between the forming roll and the web transfer device, thereby resulting in minimal directional changes of the paper web after formation thereof about the forming roll and prior to separation of the paper web from the forming wire.

According to another advantageous embodiment of the present invention, the paper making apparatus may further include a dewatering section, following the forming section, for partially dewatering the paper web. The dewatering section preferably includes a vacuum dewatering device disposed adjacent the forming wire for dewatering the paper web through the forming wire. The dewatering section may further include a pressure dewatering device disposed adjacent the TAD fabric, generally opposite the vacuum dewatering device, for facilitating dewatering of the paper web through the forming wire. Preferably, the pressure dewatering device comprises at least one of a pressure chamber and an air knife. The web transfer device follows the dewatering section and further includes a suction device disposed adjacent the TAD fabric for retaining the paper web on the TAD fabric.

A paper making apparatus according to embodiments of the present invention may further include a web structuring device, following the web transfer device and disposed adjacent the TAD fabric, for structuring and further dewatering the paper web. The paper web is then transported to the water-removing section, wherein the water-removing section is preferably adapted to dry the paper web with minimal compaction thereof. The water-removing section preferably comprises at least one of an inward flow through-air dryer and outward flow through-air dryer. In one embodiment, the water-removing section may comprise a final drying section having at least one through-air dryer for drying the paper web. In an alternate embodiment, the water-removing section may comprise a pre-drying section having at least one through-air dryer for partially drying the paper web and a final drying section having a Yankee dryer for further drying the paper web.

According to an advantageous embodiment of the paper making apparatus of the present invention, the forming wire and the TAD fabric, with the paper web sandwiched therebetween, travel between the forming roll and the web transfer device with less than about 90 degrees of directional change of the paper web after formation thereof and prior to separation of the paper web from the forming wire. In one particularly advantageous embodiment, the paper web experiences between about 2 degrees and about 5 degrees of directional change between the forming roll and the web transfer device. Further, the path between the forming roll and the web transfer device preferably has a minimal length which, in some embodiments, is no longer than about 1.5 meters.

Another advantageous aspect of the present invention comprises a method of producing a web of paper. A paper web is first formed between a forming wire and a through-air drying (TAD) fabric guided to travel about a portion of the circumference of a forming roll in a twin-fabric forming section. The paper web is then separated from the forming wire at a web transfer device such that the paper web is supported by the TAD fabric. The forming section and the web transfer device are preferably arranged such that the forming wire and the TAD fabric, with the paper web sandwiched therebetween, travel along a substantially straight path between the forming roll and the web transfer device. Most preferably, the paper web experiences minimal directional change after formation thereof about the forming roll and prior to separation of the paper web from the forming wire. Following separation of the forming wire, the paper web is then transported on the TAD fabric through a water-removing section having at least one through-air dryer for drying the paper web.

In one embodiment, the method may further include the step of dewatering the paper web through the forming wire following the forming step. Preferably, the dewatering step further comprises dewatering the paper web through the forming wire with at least one of a vacuum dewatering device disposed adjacent the forming wire and a pressure dewatering device disposed adjacent the TAD fabric. In addition, the separating step may further comprise retaining the paper web on the TAD fabric using a suction device disposed adjacent the TAD fabric. Following the separation step, the method may further include the step of structuring the paper web using a web structuring device. The separating step comprises transporting the paper web between the forming roll and the web transfer device with less than about 90 degrees of directional change of the paper web after formation thereof about the forming roll and prior to separation of the paper web from the forming wire. Preferably, the paper web is transported between the forming roll and the web transfer device with between about 2 degrees and about 5 degrees of directional change. The path between the forming roll and the web transfer device preferably has a minimal length which, in some embodiments, is no longer than about 1.5 meters.

Preferably, the transporting step further comprises transporting the paper web through the water-removing section with minimal compaction thereof. In addition, the transporting step preferably comprises transporting the paper web through at least one of an inward flow through-air dryer and an outward flow through-air dryer. In one embodiment, the transporting step further comprises transporting the paper web through a final drying section having at least one through-air dryer for drying the paper web. In an alternate embodiment, the transporting step further comprises transporting the paper web through a pre-drying section having at least one through-air dryer for partially drying the paper web and a final drying section having a Yankee dryer for further drying the paper web.

Thus, it will be appreciated that embodiments of the present invention utilize two fabrics for forming the paper web and transporting the paper web through a water-removing section. Utilizing two fabrics, instead of the three fabrics typically required in a TAD paper making machine having a twin wire forming section, provides a TAD paper making machine requiring a lower investment and which minimizes operational, maintenance, and space concerns. The elimination of one of the three fabrics typically required in a TAD paper making machine thereby reduces the investment cost and the operational and maintenance concerns usually associated with each additional fabric. For example, it becomes unnecessary to remove the water retained by the TAD fabric since the TAD fabric is configured to receive the wet paper web directly thereon in the forming section. Since less components are required according to embodiments of the present invention than with a three fabric system, a more compact paper making machine is obtained which generally requires less space for installation due to a smaller footprint. Further, the arrangement of the components of the paper making apparatus according to embodiments of the present invention, such that the paper web is transported from about the forming roll to the web transfer device over a relatively short distance with minimal directional change thereof, minimizes deleterious shear forces in the paper web and thereby produces a more consistent and damage-free paper web. A further advantage is realized in the process due to the paper web being formed directly on a relatively coarse and open TAD fabric. The resulting paper web is better formed with a more bulky and structured fiber network, wherein the wet and loose paper fiber typically has a more readily reorganizable structure for filling the openings in the TAD fabric to form a more desirable fiber network. It will be recognized, therefore, that the present invention facilitates the achievement of these and other distinct advantages over prior art paper making devices.

BRIEF DESCRIPTION OF THE DRAWINGS

Some of the advantages of the present invention having been stated, others will appear as the description proceeds, when considered in conjunction with the accompanying drawings, which are not necessarily drawn to scale, in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
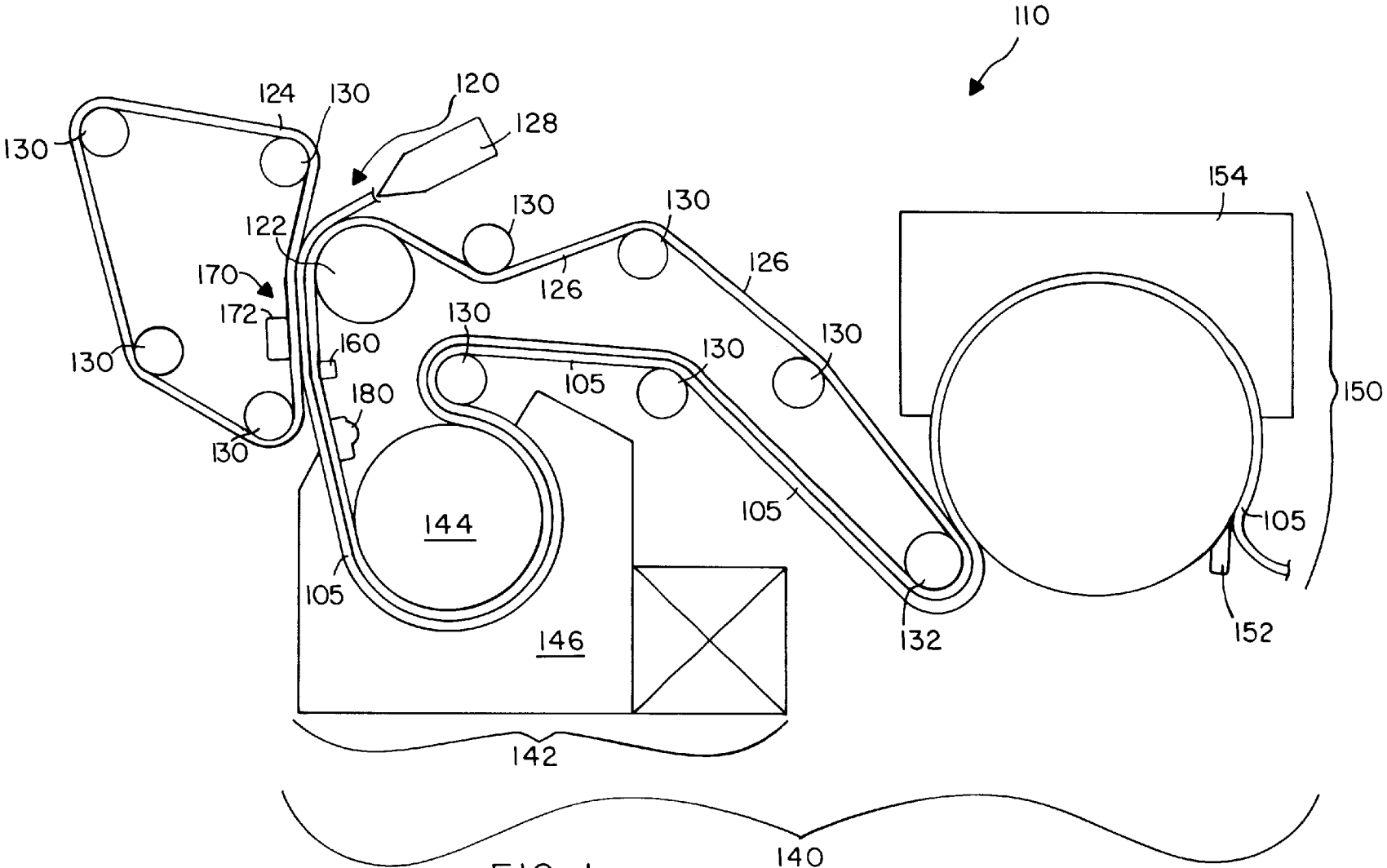
FIG. 1 is a schematic representation illustrating one embodiment of the present invention having a pre-drying section comprising a single inward flow TAD and a final drying section comprising a Yankee dryer.

FIG. 1 discloses an embodiment of a paper making apparatus, indicated generally by the numeral 110, which includes the features of the present invention. The apparatus 110 generally comprises a twin-fabric forming section 120, a water-removing section 140, and a web transfer device 160 disposed between the forming section 120 and the water-removing section 140.

The twin-fabric forming section 120 includes a forming roll 122, a pair of fabrics 124 and 126, and a headbox 128. Each of the fabrics 124 and 126 forms a continuous loop about a number of guide rolls 130 and are disposed relative to each other such that both fabrics 124 and 126 converge as they are guided to travel about a portion of the circumference of the forming roll 122. The headbox 128 is disposed adjacent the forming roll 122 where the fabrics 124 and 126 converge, wherein the headbox 128 is operable to deposit a slurry between the fabrics 124 and 126 so as to form a paper web 105 therebetween. Preferably, one of the fabrics 124 comprises a forming wire while the other fabric 126 comprises a through-air drying (TAD) fabric. Further, in a preferred embodiment of the present invention, the TAD fabric 126 is configured such that it forms a loop about the forming roll 122 and travels adjacent thereto after the formation of the paper web 105. The forming wire 124 thus runs adjacent to the TAD fabric 126 on the opposite side thereof from the forming roll 122. The headbox 128 deposits a slurry between the fabrics 124 and 126 at the forming roll 122 to form the paper web 105. Typically, in comparison with a forming wire, a TAD fabric is relatively coarse and more open (less dense). Thus, forming the paper web directly on the TAD fabric will tend to increase the bulk of the paper web and the fibers in the paper web will be distributed to form a more desirable structure of the fiber network.

Following formation of the paper web 105 about a portion of the forming roll 122, the paper web 105 remains sandwiched between the forming wire 124 and the TAD fabric 126. The paper web 105 is then directed downstream in this manner to a web transfer device 160, at which point the paper web 105 is separated from the forming wire 124 such that the paper web 105 is transported through the water-removing section 140 by the TAD fabric 126. Between the forming roll 122 and the web transfer device 160, the apparatus 110 may further include a dewatering section 170 for partially dewatering the paper web 105. In one embodiment of the present invention, the dewatering section 170 may comprise a vacuum dewatering device 172 disposed within the forming wire 124 loop. In this configuration, the vacuum dewatering device 172 partially dewaters the paper web 105 through the forming wire 124. In some embodiments of the present invention, the dewatering section may further include a pressure dewatering device (not shown) disposed within the TAD fabric 126 loop, generally opposite the vacuum dewatering device 172. The pressure dewatering device forces a drying medium through the TAD fabric 126 and the paper web 105 and assists the vacuum dewatering device 172 in dewatering the paper web 105 through the forming wire 124. Such a pressure dewatering device may include, for example, a pressure chamber or an air knife.

The paper web 105 is then transported, still between the forming wire 124 and the TAD fabric 126, to a web transfer device 160. The web transfer device 160 may comprise, for example, a suction transfer box or the like. At the web transfer device 160, the paper web 105 is separated from the outer forming wire 124. Thus, the web transfer device 160 is preferably configured such that the paper web 105 is retained on the TAD fabric 126 and transported thereon to further downstream processes in the apparatus 110. For example, a suction transfer box may be disposed within the TAD fabric 126 loop to assist in retaining the paper web 105 on the TAD fabric 126 as it separates from the forming wire 124. In one embodiment of the present invention, a suction transfer box may be disposed adjacent the TAD fabric 126 and adapted to use a pressure differential of between about 30 kilopascals (kPa) and about 50 kPa over the paper web 105 to retain the paper web 105 on the TAD fabric 126.

According to a preferred embodiment of the present invention, the paper web 105 is transported between the forming roll 122 and the web transfer device 160 while sandwiched between the forming wire 124 and the TAD fabric 126, wherein the span between the forming roll 122 and the web transfer device 160 is minimized and the paper web 105 is exposed to little or no directional change therebetween. Typically, if the paper web 105 sandwiched between the forming wire 124 and the TAD fabric 126 passes about an object which causes a directional change thereof, such as a guide roll 130, the fabric closest to the object will tend to travel farther than the distant fabric on the opposite side of the paper web 105. When one fabric runs ahead of the other, internal shear stresses are formed in the paper web 105 which may lead to damage thereof. Thus, most preferably, the distance traversed between the forming roll 122 and the web transfer device 160 by the paper web 105 sandwiched between the forming wire 124 and the TAD fabric 126 is kept relatively short and as straight as possible. In a preferred embodiment, the paper web 105 is transported in a substantially straight path between the forming roll 122 and the web transfer device 160, wherein length of the path is less than about 1.5 meters. In some embodiments of the present invention, it may be sufficient for the paper web 105 to be exposed to a directional change between the forming roll 122 and the web transfer device 160 of less than about 90 degrees after the paper web 105 is formed about the forming roll 122 and prior to separation of the forming wire 124. For example, in one particularly advantageous embodiment, the sandwiched paper web is exposed to a directional change of between about 2 degrees and about 5 degrees while the length of the path over which the sandwiched paper web travels is no longer than about 1.5 m.

At the web transfer device 160, the paper web 105 is separated from the forming wire 124. Preferably, the paper web 105 is retained on the TAD fabric 126 by a suction device disposed within the TAD fabric 126 loop as the paper web 105 is separated from the forming wire 124. In some embodiments of the present invention, if imprinting of the paper web 105 is desired, a web imprinting device 180 such as, for example, an embosser, may be disposed downstream of the web transfer device 160 for imprinting the paper web 105. The web imprinting device 180 may comprise, for example, a suction device such as a multi-slot suction box disposed adjacent the TAD fabric 126. The suction device, if used for imprinting the paper web 105, forcibly draws the unsupported portions of the paper web 105 into the openings in the TAD fabric 126 and serves to further dewater the paper web 105. Preferably, such a suction device utilizes a pressure differential applied across the paper web 105 of between about 30 kPa and about 70 kPa to imprint the paper web 105.

The paper web 105 is then transported on the TAD fabric 126 to the water-removing section 140. Preferably, the water-removing section 140 includes at least one through-air dryer 142, wherein a through-air dryer 142 generally comprising a rotatable porous cylinder 144 and a hood 146. Typically, the TAD fabric 126 and the paper web 105 wrap about a portion of the porous cylinder 144 and air is blown therethrough to at least partially dry the paper web 105. The TAD fabric 126 and the paper web 105 are guided about the porous cylinder 144 by at least one guide roll 130. The hood 146 is generally disposed to cover the portion of the surface of the porous cylinder 144 about which the TAD fabric 126 and the paper web 105 are wrapped. In some embodiments of the present invention, the water-removing section 140 may comprise one or more through-air dryers 142 and thus constitute a final drying section of the apparatus 110. However, in some embodiments of the present invention, a Yankee dryer 150 may be disposed downstream of the at least one through-air dryer 142 for further drying the paper web 105. In embodiments where the apparatus 110 includes at least one through-air dryer 142 and a Yankee dryer 150, the at least one through-air dryer 142 constitutes a pre-drying section while the Yankee dryer 150 constitutes a final drying section. A Yankee dryer 150 is a large diameter drum which is internally heated with steam to provide a hot surface for completely drying the paper web 105. The Yankee dryer 150 is also typically employed to shorten the paper web 105 in the machine direction so as to make it thicker, bulkier, and extensible in the machine direction in a process known as creping, which is accomplished by a doctor blade 152 that, on removal of the paper web 105 from the Yankee dryer 150, creates a multitude of microfolds in the paper web 105 extending in the cross-machine direction.

The TAD fabric 126 and the paper web 105 are generally directed away from the at least one through-air dryer 142 and toward the Yankee dryer 150 by at least one guide roll 130. At the Yankee dryer 150, the TAD fabric 126 and the paper web 105 pass about a portion of the surface of a press roll 132, where the paper roll 105 is then transferred onto the Yankee dryer 150. Preferably, the at least one guide roll 130 guiding the TAD fabric 126 and the paper web 105 from the at least one through-air dryer 142 and the press roll 132 are configured and arranged so as to minimize compression or compaction of the paper web 105 as it is transported between the at least one through-air dryer 142 and the Yankee dryer 150.

By minimizing the shear stress in the paper web 105 during the forming process and minimizing compression or compaction of the paper web 105 during the water-removing process, the paper web 105 will tend to better retain most of its structure during subsequent processing steps. For example, a dried paper web produced by embodiments of the present invention may retain its structure even after absorption of water or other liquid, whereas a paper web produced by a prior art paper making apparatus, wherein the paper web is embossed after drying, will lose its structure when it absorbs water or other liquid such that the paper web becomes flat. Further, when a Yankee dryer 150 is used as the final dryer from which the paper web 105 is creped by the doctor blade 152, the creped paper web 105 can be calendered to achieve additional tactile surface softness. Alternatively, the creped paper web 105 may be creped from the Yankee dryer 150 and wound directly onto a parent roll (not shown).

Figure 2:
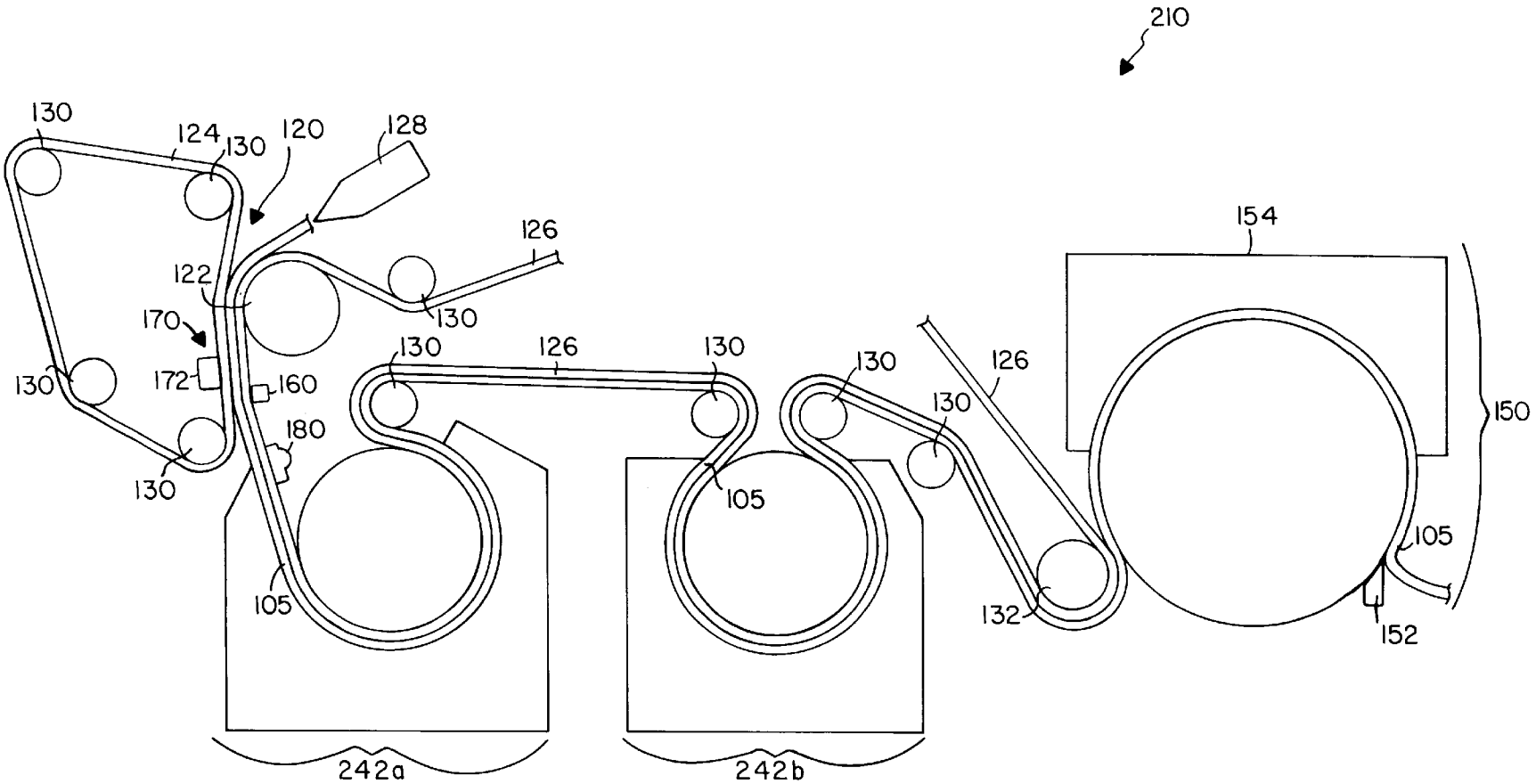
FIG. 2 is a schematic representation of an alternate embodiment of the present invention having a pre-drying section comprising multiple inward flow TADs and a final drying section comprising a Yankee dryer.

As shown in FIG. 1, the paper making apparatus 110 includes a pre-drying section having one through-air dryer 142 and a final drying section having a Yankee dryer 150. The through-air dryer 142 is configured in an inward flow arrangement, wherein the drying air is flowed from the hood 146 through the paper web 105 and the TAD fabric 126, and into the interior of the porous cylinder 144. Note that embodiments of a paper making apparatus 110 according to the present invention, having at least one through-air dryer 142, may include different hood 146 configurations. For example, the hood 146 may be fabricated as a one-piece assembly or, to facilitate access for service of the TAD unit 142, may be formed as an assembly comprising two or more pieces. Multi-TAD paper making devices may extend this flexibility in hood configuration to allow a separate hood for each TAD unit or a common hood for all of the TAD units according to the spirit and the scope of the present invention. FIG. 2 discloses an alternate embodiment of a paper making apparatus 210 that is similar to the embodiment shown in FIG. 1, but includes two inward flow through-air dryers 242*a* and 242*b* in the pre-drying section.

Figure 3:
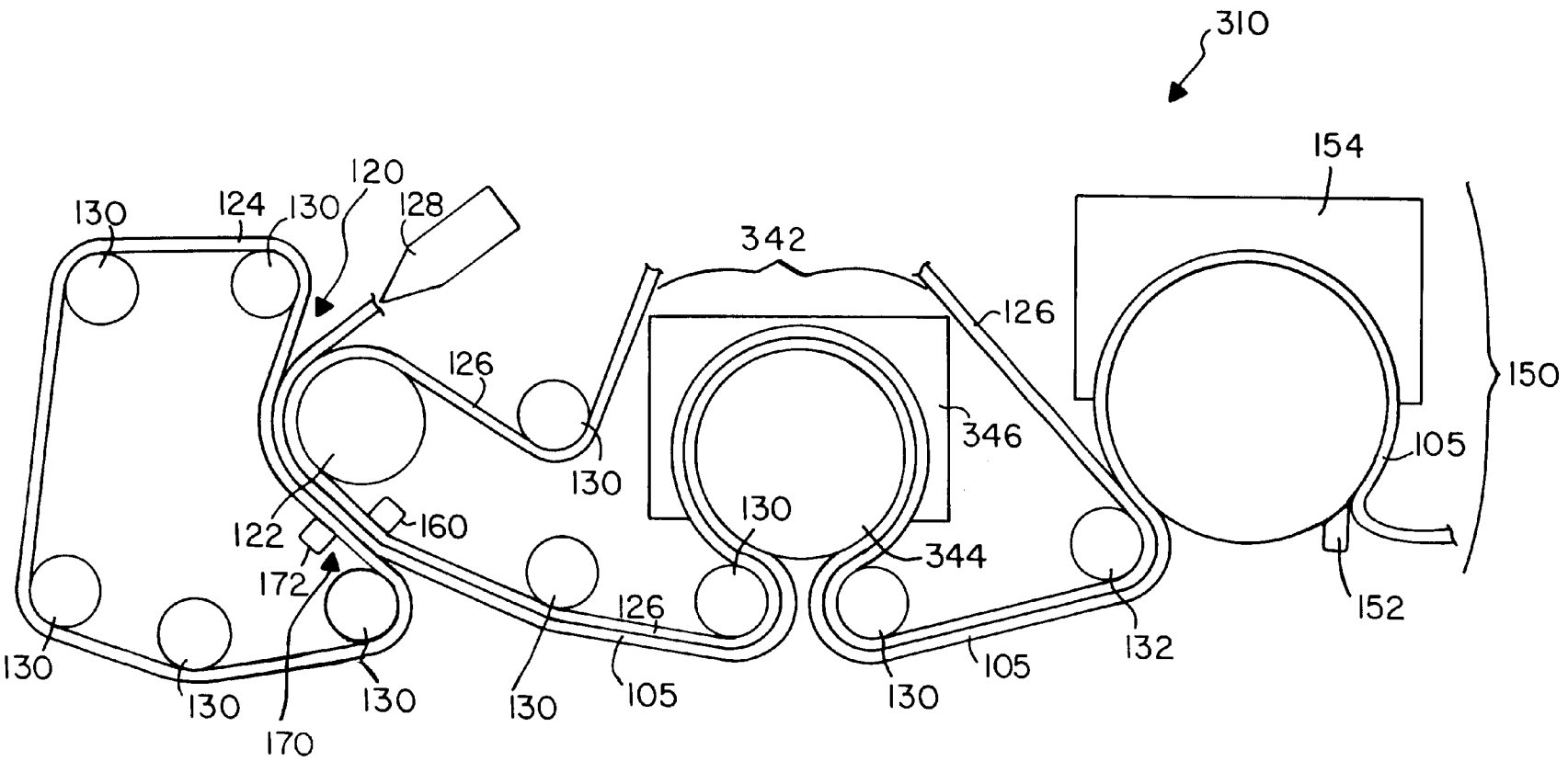
FIG. 3 is a schematic representation of another alternate embodiment of the present invention having a pre-drying section comprising a single outward flow TAD and a final drying section comprising a Yankee dryer.
Figure 4:
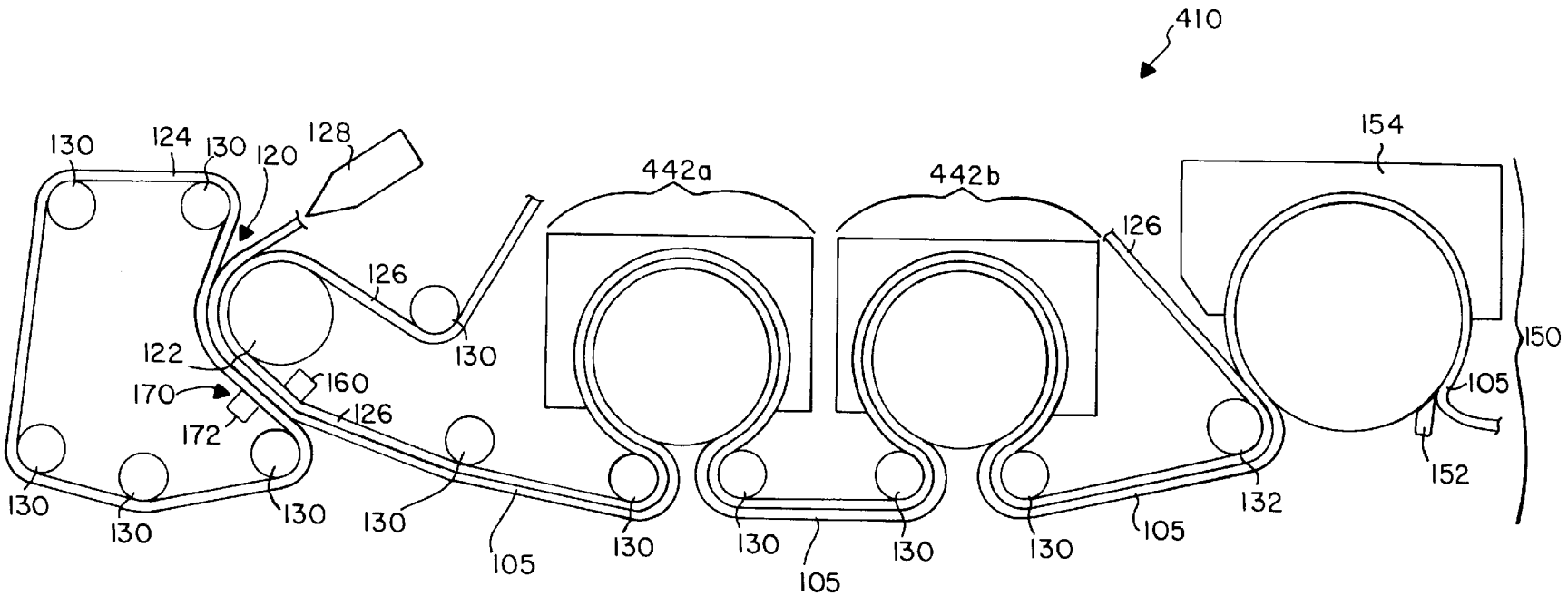
FIG. 4 is a schematic representation of still another embodiment of the present invention having a pre-drying section comprising multiple outward flow TADs and a final drying section comprising a Yankee dryer.

FIGS. 3 and 4 disclose further alternate embodiments of the present invention having both a pre-drying section and a final drying section. FIG. 3 shows an embodiment of the apparatus 310 of the present invention wherein the pre-drying section comprises a single outward flow through-air dryer 342. In an outward flow through-air dryer 342, the drying air flows from the interior of the porous cylinder 344, through the paper web 105 and the TAD fabric 126, and into the hood 346. FIG. 4 shows another embodiment of the present invention similar to the embodiment shown in FIG. 3, where the pre-drying section has been modified to include two outward flow through-air dryers 442*a* and 442*b*.

Figure 5:
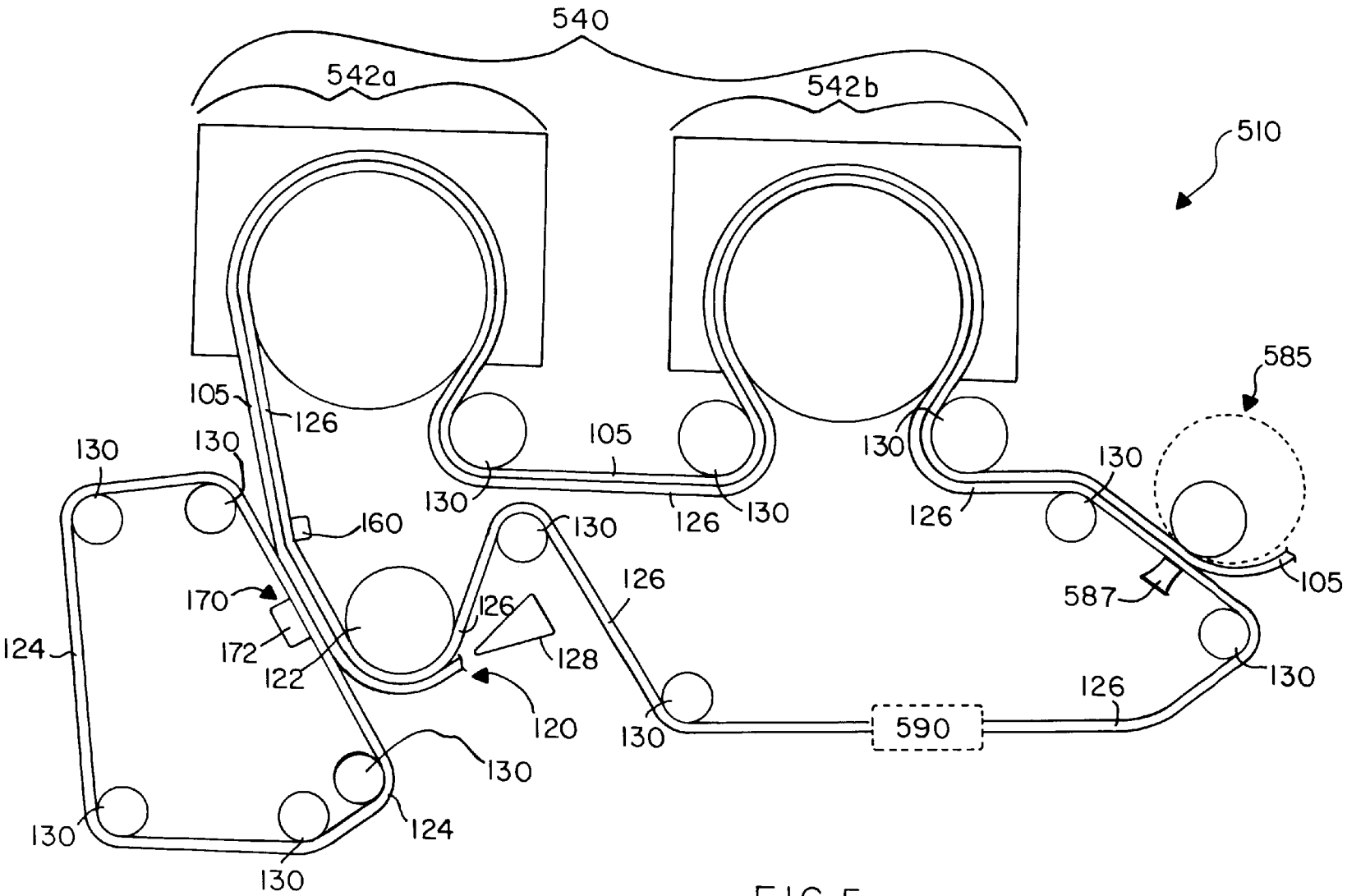
FIG. 5 is a schematic representation of still another alternate embodiment of the present invention having a final drying section comprising multiple inward flow TADs.

FIG. 5 shows still another alternate embodiment of the present invention having at least one through-air dryer, wherein two inward flow through-air dryers 542*a* and 542*b* are shown, for drying the paper web 105. Since this embodiment of the apparatus 510 does not include a Yankee dryer, the through-air dryers 542*a* and 542*b* comprise the final drying section for the paper web 105. Thus, after the TAD fabric 126 and the paper web 105 exit the final through-air dryer, the paper web 105 is separated from the TAD fabric 126 by a separation device 585 comprising, for example, a reel-up or, in the alternative, a transfer device such as a suction roll. The separation device 585 may be further assisted by an air jet device such as, for example, an air knife 587, disposed within the loop of the TAD fabric 126 generally opposite the separation device 585. The air jet device, such as the air knife 587, blows air through the TAD fabric 126 to assist the separation device 585 in separating the paper web 105 from the TAD fabric 126. Where the separation device 585 is used, the paper web 105 is separated from the TAD fabric 126 and directed to a reel-up (not shown). As further shown in FIG. 5, once the paper web 105 is separated from the TAD fabric 126, the TAD fabric 126 is directed through a cleaning section 590, as indicated in dashed lines, before it is directed back to the web forming section 120. As configured, the cleaning section 590 for the TAD fabric 126 is disposed beneath the through-air dryers 542*a* and 542*b* and thus advantageously obviates the need for elaborate catch pans and other measures to prevent condensation which, in prior art paper making machines having a cleaning section disposed above a water-removing section, are necessary to prevent cleaning water from the cleaning section from dripping onto the paper web as it passes through the water-removing section.

Figure 6:
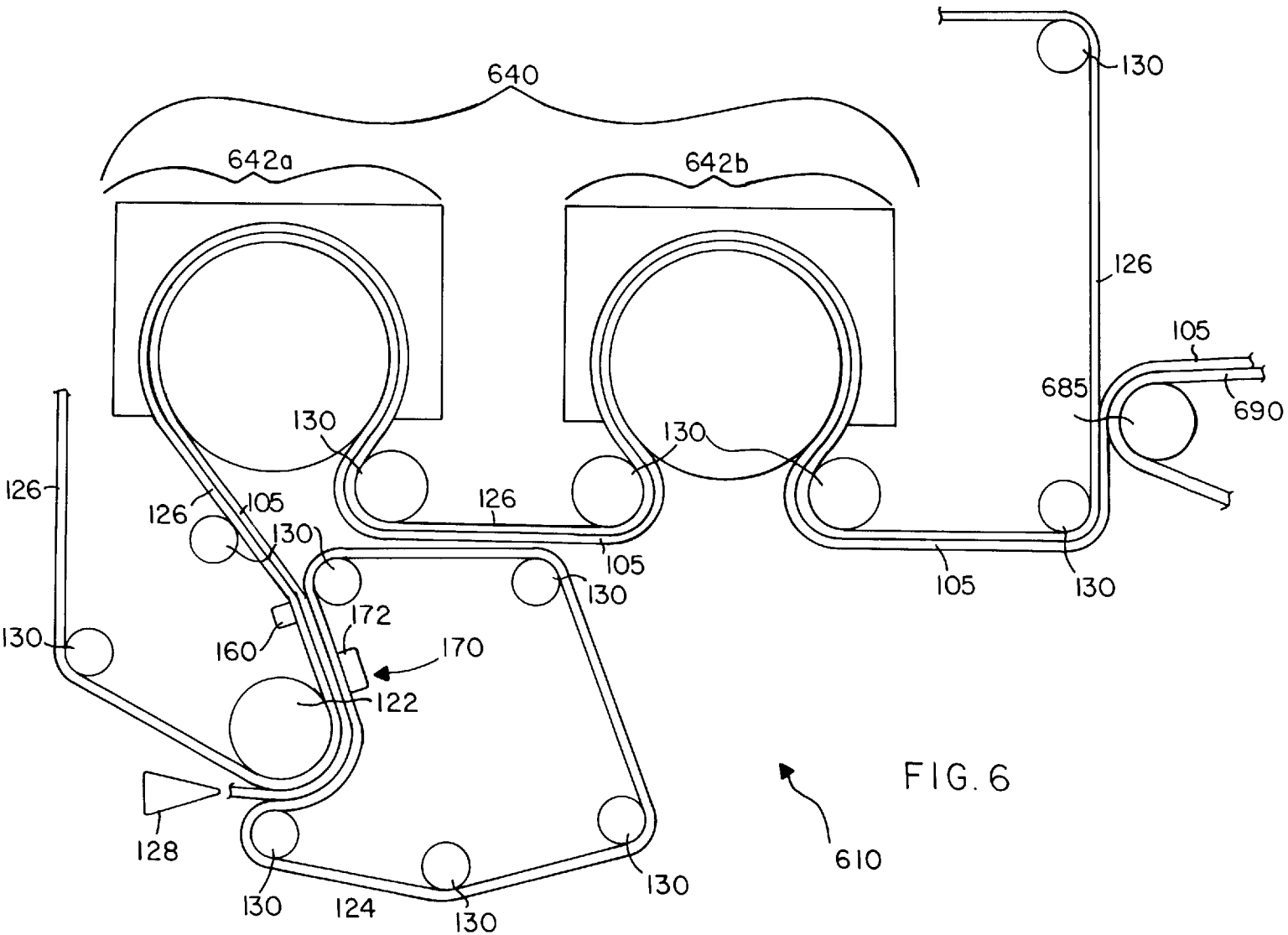
FIG. 6 is a schematic representation of still another alternate embodiment of the present invention having a final drying section comprising multiple outward flow TADs.

FIG. 6 discloses yet another alternate embodiment of a paper making apparatus 610 according to the present invention wherein the water-removing section 640 comprises at least one outward flow through-air dryer, wherein two outward flow through-air dryers 642*a* and 642*b* are shown. Since this configuration of the apparatus 610 does not include a Yankee dryer, the outward flow through-air dryers 642*a* and 642*b* comprise the final dryers for the paper web 105. Following the final through-air dryer, the paper web 105 is separated from the TAD fabric 126 by a separation device 685, which may be, for example, a vacuum roll or like devices which are known in the art for separating the paper web 105 from the TAD fabric 126, and transported to a reel-up (not shown) by, for example, a permeable fabric 690.

Thus, a paper making apparatus according to embodiments of the present invention utilizes two fabrics for forming and drying a paper web. The use of only two fabrics reduces initial investment costs and allows the design of the apparatus to be simplified. A simplified design allows the length of the TAD fabric to be decreased, thereby further allowing the apparatus to be more compact and further reducing investment costs. In addition to reducing investment costs, the more compact and less complex paper making machine reduces operational and maintenance costs and is more space efficient. In addition, the provision of a substantially straight and relatively short path between the forming section and the web transfer section of the apparatus minimizes shear stresses in the paper web and thereby produces a more consistent and damage-free paper web.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for making paper, comprising:

a twin-fabric forming section including a forming wire and a through-air dryer (TAD) fabric arranged to pass together in face-to-face disposition about a forming roll, and a headbox arranged to deposit a papermaking slurry between the forming wire and TAD fabric so as to form a paper web therebetween;

a through-air dryer following the forming section for drying the paper web, the TAD fabric being arranged to carry the paper web through the through-air dryer, the through-air dryer including a porous cylinder about which the TAD fabric passes while supporting the paper web; and a web transfer device disposed between the forming roll and the through-air dryer, the web transfer device comprising a suction device disposed on an opposite side of the TAD fabric from the paper web and operable to exert suction on the paper web through the TAD fabric so as to cause the paper web to be separated from the forming wire and adhere to the TAD fabric;

wherein the forming wire, paper web, and TAD fabric follow a substantially straight path between the forming roll and the web transfer device, and wherein the forming roll and the porous cylinder of the through-air dryer are disposed substantially vertically one above the other and said substantially straight path between the forming roll and the web transfer device is generally vertical, whereby a compact arrangement is achieved for the apparatus.

2. The apparatus of claim 1, wherein the forming roll is above the porous cylinder of the through-air dryer.

3. The apparatus of claim 1, wherein the forming roll is below the porous cylinder of the through-air dryer.

4. The apparatus of claim 1, wherein the TAD fabric and paper web are guided about the porous cylinder by the web transfer device disposed adjacent an inlet to the through-air dryer and a guide roll disposed adjacent an outlet from the through-air dryer.

* * * * *